US012016474B2

(12) United States Patent
Berg

(10) Patent No.: US 12,016,474 B2
(45) Date of Patent: Jun. 25, 2024

(54) PRESSED PAPERBOARD BOWL WITH WIDE UPPER RIM

(71) Applicant: GPCP IP Holdings LLC, Atlanta, GA (US)

(72) Inventor: Eric John Berg, Neenah, WI (US)

(73) Assignee: GPCP IP Holdings LLC, Atlanta, GA (US)

( * ) Notice: Subject to any disclaimer, the term of this patent is extended or adjusted under 35 U.S.C. 154(b) by 0 days.

(21) Appl. No.: 17/735,758

(22) Filed: May 3, 2022

(65) Prior Publication Data

US 2023/0011217 A1 Jan. 12, 2023

Related U.S. Application Data

(60) Provisional application No. 63/220,178, filed on Jul. 9, 2021.

(51) Int. Cl.
*A47G 19/03* (2006.01)
*B65D 1/34* (2006.01)

(52) U.S. Cl.
CPC ..... *A47G 19/03* (2013.01); *B65D 1/34* (2013.01)

(58) Field of Classification Search
CPC ..... B65D 1/34; B65D 2543/00092; B65D 2543/00648; A47G 19/03; A47G 19/02; B31B 2110/20; B31B 50/592
USPC ..... 229/406, 407; 220/574, 657, 608
See application file for complete search history.

(56) References Cited

U.S. PATENT DOCUMENTS

| | | | | |
|---|---|---|---|---|
| 5,088,640 | A | 2/1992 | Littlejohn | |
| 5,326,020 | A | 7/1994 | Cheshire | |
| 6,715,630 | B2 | 4/2004 | Littlejohn | |
| 7,048,176 | B2 | 5/2006 | Littlejohn | |
| 8,177,119 | B2 | 5/2012 | Littlejohn | |
| 8,584,929 | B2 * | 11/2013 | Littlejohn | B65D 43/0212 220/574 |
| 9,538,870 | B2 * | 1/2017 | Littlejohn | A47G 19/03 |
| 9,555,594 | B2 * | 1/2017 | Littlejohn | B31B 50/592 |
| 9,655,461 | B2 * | 5/2017 | Littlejohn | A47G 19/03 |
| 9,833,088 | B2 * | 12/2017 | Littlejohn | B65D 43/0212 |
| 9,848,719 | B2 * | 12/2017 | Littlejohn | B65D 1/34 |
| 2006/0208054 | A1 * | 9/2006 | Littlejohn | B65D 43/0212 229/406 |
| 2017/0065110 | A1 * | 3/2017 | Littlejohn | A47G 19/03 |

* cited by examiner

*Primary Examiner* — Christopher R Demeree

(57) ABSTRACT

A disposable bowl press-formed from a generally planar paperboard blank. The bowl has a large capacity, wide flange for easy handling and exhibits excellent rim stiffness. The bowl can include a bottom panel, a sidewall extending upwardly and outwardly from the bottom panel and a flange extending outwardly from the sidewall. The flange includes a rim portion having an arched central crown with a convex upper surface defining a radius of curvature RC of 0.650 to 1.180; and annular transition from the rim portion defining a radius of curvature, R3, and an evert extending downwardly from the annular transition, R3, wherein the bowl has an outermost diameter D of about 8" to about 10" and a height to diameter ratio, H/D, of from 0.18 to 0.20.

20 Claims, 3 Drawing Sheets

PRESSED PAPERBOARD BOWL WITH WIDE UPPER RIM

CROSS-REFERENCE TO RELATED APPLICATIONS

This application claims priority to U.S. Provisional Patent Application having Ser. No. 63/220,178, filed on Jul. 9, 2021. The entirety of which is incorporated by reference herein.

BACKGROUND

Field

Embodiments described herein generally relate to disposable food containers. More particularly, such embodiments relate to pressed paperboard bowls.

Description of the Related Art

Disposable paper food containers, such as plates, trays and bowls, are made by way of pulp-molding processes or by pressing a planar paperboard blank in a matched metal heated die set. The paperboard is conventionally produced by a wet laid paper making process and is typically available in the form of a continuous web on a roll. In a typical forming operation, the web of paperboard stock is fed continuously from a roll through a cutting die to form the circular blanks which are then fed into position between the upper and lower die halves.

Disposable food containers are generally configured to include a bottom portion, a relatively steep, generally straight sidewall as well as an outer arcuate flange. This profile has been found to be particularly suitable for disposable containers such as plates, platters, bowls and the like because it combines improved physical properties with manufacturing advantages such as pleating control and off-center forming tolerance to improve the overall strength and rigidity on the formed product. Currently available pressware plate lines include, for example, those disclosed and generally described in U.S. Pat. No. 5,088,640 to Littlejohn and U.S. Pat. No. 5,326,020 to Cheshire et al.

Products configured in accordance with the design described in the '640 patent are typically intended to be a lower basis weight, lower performance, less expensive product for everyday, typically lighter duty usage. Generally speaking these products use a four radius profile which generally provides: (1) enhanced strength versus previously known designs, (2) higher press speeds than otherwise available, (3) improved pleating control (with or without scoring) and (4) improved product consistency in terms of rigidity and individual product appearance versus other designs.

Available products of the general class described in the '020 patent are typically higher basis weight and higher performance, more durable and costly disposable products for special use applications where additional strength is required including buffets or parties where heavy food loads are likely. Such products include for example, oval platters, deep dish containers, and bowls. These products typically exhibit: (1) enhanced product rigidity per material utilization, especially for the higher basis weight paperboards, (2) adequate press converting speeds and (3) adequate pleating control for mid to high basis weight paperboards. Scoring is typically required for adequate pleating control for these products.

The industry is continually trying to produce larger pressware products made of paper that have suitable strength and rigidity and that are visually appealing to a consumer. The industry is also in search of bigger bowls made of paper that are easy to hold and carry by the rim portion and will not collapse when full of food.

SUMMARY

Provided herein are larger, press-formed paper bowls. The bowls have a large capacity and wide flange for easy handling. Despite the significantly increased size, the press-formed paper bowls have excellent strength properties and exhibit excellent rim stiffness. In one or more embodiments, the bowls can include a bottom panel, a sidewall extending upwardly and outwardly from the bottom panel and a flange extending outwardly from the sidewall. The flange includes a rim portion having an arched central crown with a convex upper surface defining a radius of curvature RC of 0.650 to 1.180; and annular transition from the rim portion defining a radius of curvature, R3, and an evert extending downwardly from the annular transition, R3. The bowl has an outermost diameter D of about 8" to about 10" and a height to diameter ratio, H/D, of from 0.18 to 0.20.

The press-formed paper bowls can further have a wide flange that significantly improves the ergonomics and handling of the bowl. For example, the bowl can have a flange width of about 0.54 inches to about 0.65 inches, a ratio of the flange width to RC can be 0.55 to 1.00, a ratio of the flange width to D of 0.055 to 0.075, and/or a ratio of the flange width to H of 0.30 to 0.40.

BRIEF DESCRIPTION OF THE DRAWINGS

So that the manner in which the above recited features can be understood in detail, a more particular description, briefly summarized above, may be had by reference to embodiments, some of which are illustrated in the appended drawings. It is to be noted, however, that the appended drawings illustrate only typical embodiments and are therefore not to be considered limiting of its scope, for the invention may admit to other equally effective embodiments.

DETAILED DESCRIPTION

The present invention is described in detail below in connection with numerous embodiments. Such discussion is for purposes of illustration only and not intended to be limitative of the invention. Modifications to particular embodiments within the spirit and scope of the present invention, set forth in the appended claims, will be readily apparent to those of skill in the art.

Figure 1:
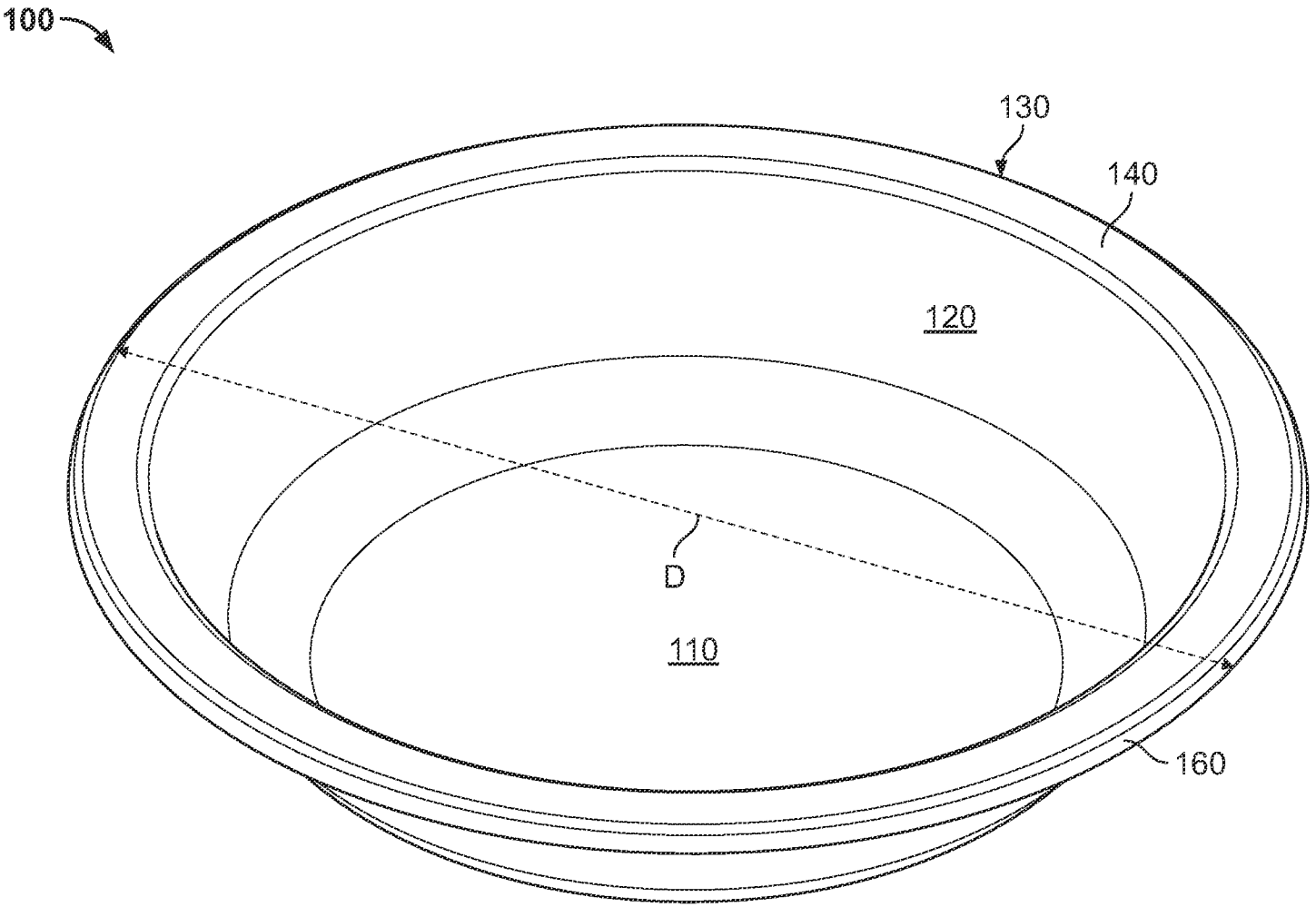
FIG. 1 depicts a perspective view of a press-formed paper bowl, according to one or more embodiments described herein.
Figure 2:
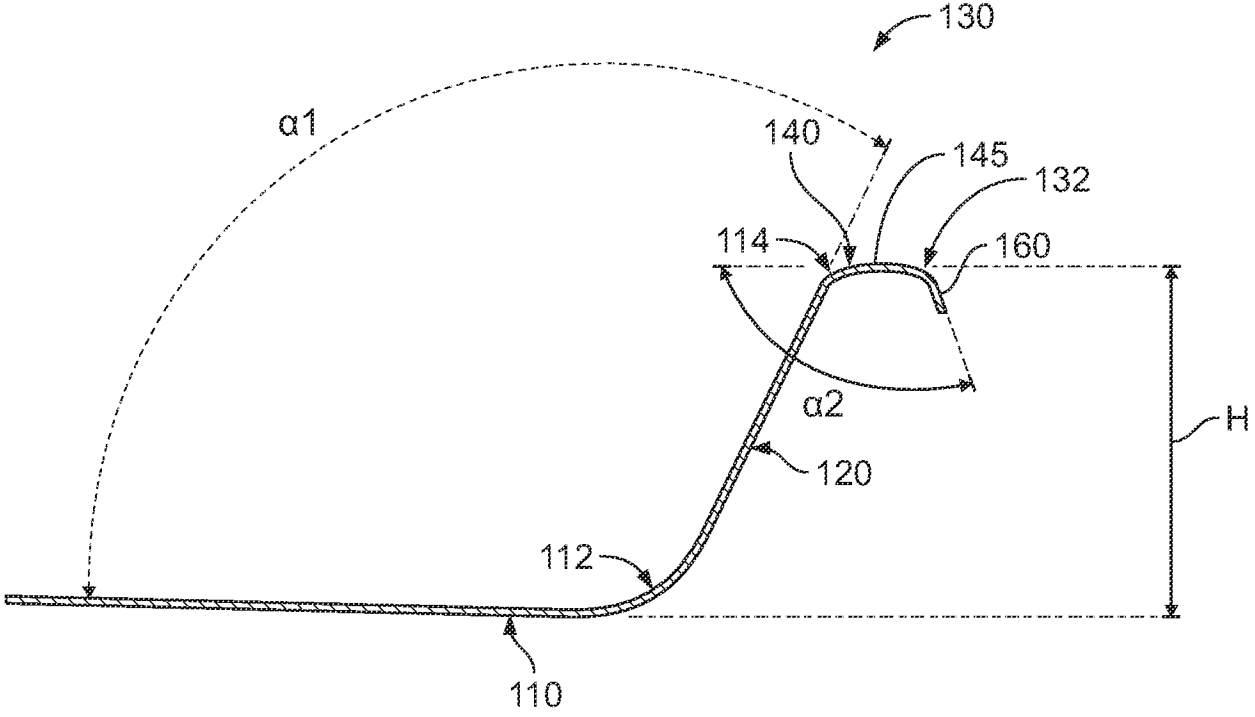
FIG. 2 depicts a partial sectional view of the bowl of FIG. 1.

FIG. 1 depicts a perspective view of an illustrative press-formed paper bowl 100, according to one or more embodiments provided herein. To better describe the outer flange portion, FIG. 2 depicts a partial sectional view of the bowl of FIG. 1. The bowl 100 has a large surface area and wide flange and still exhibits a high degree of rigidity. The bowl 100 can have a bottom panel 110, an inner sidewall 120 that can extend upwardly from the bottom panel 110, and a flange portion 130 that extends outwardly from the inner sidewall 120.

FIG. 2 depicts a partial sectional view of the bowl 100 to better illustrate the outer flange portion 130. The flange portion 130 extends from the sidewall 120 toward an evert 160. The flange portion 130 includes an upper rim 140. The upper rim 140 can be curved. The upper rim 140 can have a convex upper surface 145 (i.e. curvature) that is crowned and defines a radius of curvature (Rc). Rc can range from 0.650 to 1.180 inches. Rc can also range from a low of 0.650, 0.700, and 0.800 inches to a high of about 1.000, 1.100, or 1.180 inches.

Figure 3:
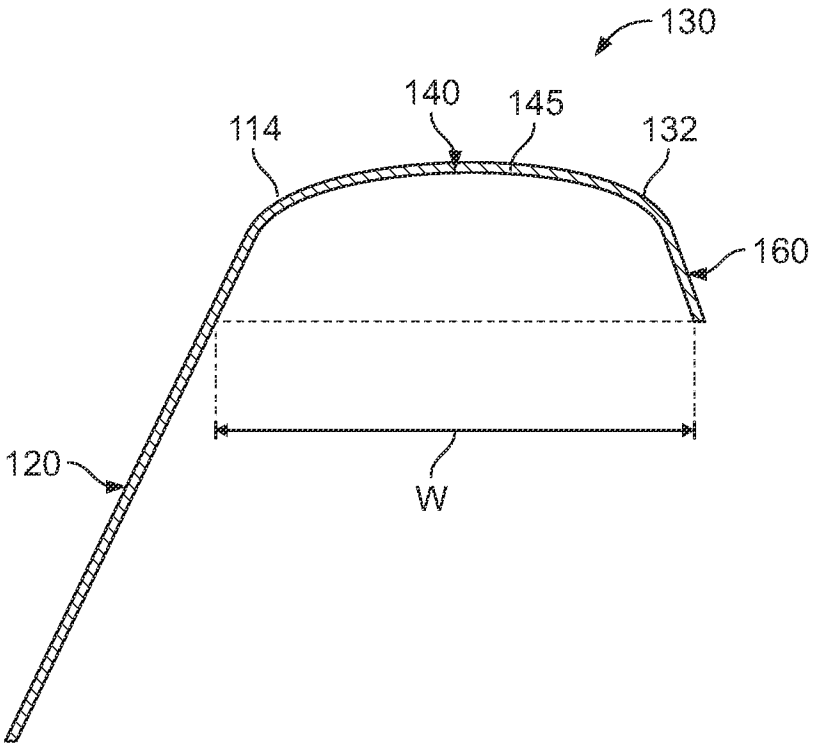
FIG. 3 depicts an enlarged view of the flange portion according to one or more embodiments described herein.

FIG. 3 depicts an enlarged view of the flange portion 130. As depicted in FIG. 3, the flange portion 130 has a width (W). The width (W) of the flange portion 130 is defined by the length of a horizontal line intersecting the sidewall 120 on one side and the end of the evert 160 on the other, as depicted in FIG. 3. The width (W) of the flange portion 130 (i.e. "flange width") can range from a low of about 0.54 inches to about 0.65 inches. The flange width (W) can also range from 0.545 inches to 0.615 inches, or from 0.550 to 0.615. Such flange width (W) is wider than that of the prior art and allows a consumer more surface area to handle and carry the bowl 100 without affecting or being affected by the contents of the bowl.

Referring again to FIG. 2, the bowl 100 can also have a first annular transition portion 112 that extends upwardly and outwardly from the bottom panel 110 to the sidewall 120. The first annular transition portion 112 defines a concave upper surface defining an inner radius of curvature R1. The bowl 100 can also have a second annular transition portion 114 that extends outwardly from the sidewall 120 to the flange portion 130. The second annular transition portion 114 defines a convex upper surface defining a radius of curvature R2. A third annular transition 132 extends downwardly and outwardly from the flange portion 130 to the evert 160. The third annular transition 132 defines a convex upper surface defining a radius of curvature R3.

The radius of curvature R1 can range from 0.25 to 1.00 inches. R1 can also range from a low of 0.25, 0.30, or 0.40 to a high of 0.50, 0.75 or 1.00 inches. R1 can also be about 0.60, 0.65, or 0.70 inches.

In certain embodiments, R2 and R3 can be the same. In certain embodiments, R2 and R3 can be different. The radius of curvature R2, for example, can range from 0.030 to 0.375 inches. R2 can also range from a low of 0.030, 0.050, or 0.100 to a high of 0.150, 0.275 or 0.375 inches. R2 can also be about 0.630, 0.780, or 0.960 inches. The radius of curvature R3 can range from 0.030 to 0.375 inches. R3 can also range from a low of 0.030, 0.050, or 0.100 to a high of 0.150, 0.275 or 0.375 inches. R3 can also be about 0.630, 0.780, or 0.960 inches.

The bowl 100 can have an overall or outer diameter (D) that is less than 11.00 inches. For example, D can range from a low of 5.75 inches to 11.00 inches. D can also range from a low of 5.75, 6.50, or 7.00 to a high of 8.00, 9.00, or 10.75 inches. D can also range from a low of 6.75 to 9.00 inches.

The bowl height (H) is indicated in FIG. 2. The bowl height (H) extends from the bottom of the bowl to the highest point of the upper rim portion 140. The height (H) can range from a low of 1.40 inches to 2.00 inches. The height (H) can also range from a low of about 1.40, 1.46, 1.52 to a high of 1.60, 1.80, or 2.00. The height (H) can also be 1.68 to 1.83 inches. The bowl 100 can have a height to overall diameter (H/D) ratio of about 0.18, about 0.19, or about 0.20.

The sidewall 120 can extend upwardly and outwardly from the bottom panel 110 at an angle $\alpha_1$, as measured from the plane of the bottom panel 110 to the plane of the inner sidewall 120. The angle $\alpha_1$, therefore, extends outwardly, greater than 90°. The angle $\alpha_1$ can range from a low of greater than 90°, about 95°, about 100°, or about 105° to a high of about 110°, about 120°, about 130°, about 140°, or about 150°. The angle $\alpha_1$ can also be greater than 90° to about 145°, greater than 90° to about 135°, greater than 90° to about 125°, greater than 90° to about 120°, greater than 90° to about 110°, or greater than 90° to about 100°. For example, the angle $\alpha_1$ can be about 95° to about 145°, about 95° to about 135°, about 95° to about 125°, about 95° to about 120°, about 95° to about 115°, about 95° to about 110°, about 95° to about 105°, or about 95° to about 100°. In other examples, the angle $\alpha_1$ can be about 105° to about 145°, about 105° to about 135°, about 105° to about 130°, about 105° to about 125°, about 105° to about 120°, about 105° to about 115°, or about 105° to about 110°. In some specific examples, the angle $\alpha_1$ can be about 100° to about 135°, about 100° to about 130°, about 100° to about 125°, about 100° to about 120°, about 100° to about 115°, about 110° to about 135°, about 110° to about 130°, about 110° to about 125°, about 110° to about 120°, or about 110° to about 115°.

The radius of curvature R3 can be further defined by a third annular transition 132 over an included angle $\alpha_2$ of from about 100° to about 150°. Typically, the included angle $\alpha_2$ is from about 105° to about 120°.

The bowl 100 can include or can be formed from one or more types of materials and/or one or more layers that can provide a suitable rigidity. In some embodiments, the bowl 100 can include or can be formed, pressed, press-formed, molded, or otherwise made from paper, paperboard, fiber, fibrous materials, fiberboard, pulp, pulp molded paper, pulp molded paperboard, webbing, clay, starch, sizing agents, natural or synthetic materials, plastic or polymeric fibers or materials including acrylic, styrene acrylic, polyethylene, polypropylene, polyethylene terephthalate, latex, or any mixture thereof. The bowl 100 can include one or more layers, films, laminates, or materials coated thereon and/or contained within. In some examples, the bowl 100 can include a clay coating, an acrylic-based coating, and/or an extruded coating or laminate film that can include polyethylene, polypropylene, polyethylene terephthalate, derivatives thereof, or any mixture thereof. The bowl 100 can include or can be formed from one or multiple layers. In some examples, the bowl 100 can include or can be formed from 1 to 15, or more layers, for example, but not limited to, a paperboard that contains multiple layers or films. The bowls 100 can likewise be prepared from paperboard laminates, for example, having multiple paperboard layers and may include three paperboard layers, two of which layers may be embossed.

In one or more embodiments, the bowl 100 can be manufactured or otherwise formed from coated paperboard, such as a clay coated paperboard blank or substrate. The paperboard blank or substrate can be printed with a design or decoration and coated with a grease and/or water resistant barrier. In some examples, the paperboard blank can be completely planar or substantially planar prior to being pressed and formed into the bowl 100. In some embodiments, the paperboard blank can be scored and/or pleated. For example, the paperboard blank can also have about 20 to about 160 scores that are equally spaced around the circumference, more preferably about 20 to about 150, or about 20 to about 120.

The bowl 100 can be pleated about a portion or about the entire periphery thereof, extending from slightly above the bottom panel 110 to the outer periphery of the flange portion 130 as is shown in FIG. 1. The bowl 100 provided herein can also be formed from scored paperboard blanks.

Considering the bottom panel 110 in more detail, the bottom panel 110 can be substantially horizontal or substantially flat, as depicted in the figures. In other embodiments, the bottom panel 110 has an arched central crown with a convex upper surface. In at least one specific embodiment, the arched central crown can define a substantially continuous, convex arched profile spanning at least 75% of the horizontal distance between a center of the bottom panel 110 and the first annular transition 112.

The bowl 100 can be evaluated for SSI or FPI rigidity, which are both expressed in grams of force per 0.5 inches of deflection. The FPI Rigidity can be measured using a Food Service Packaging Institute Rigidity Tester, available from or through the Food Service Packaging Institute, 150 S. Washington Street, Suite 204, Falls Church, VA 22046. SSI rigidity is measured with the Single Service Institute Plate Rigidity Tester of the type originally available through Single Service Institute, 1025 Connecticut Ave., N.W., Washington, D.C. The SSI rigidity test apparatus has been manufactured and sold through Sherwood Tool, Inc. Kensington, Conn.

These tests are designed to measure the rigidity (i.e., resistance to bending) of paper and plastic plates, bowls, dishes, and trays by measuring the force required to deflect the rim of these products a distance of 0.5 inch while the product is supported at its geometric center. Specifically, a product specimen is restrained by an adjustable bar on one side and is center supported. The rim or flange side opposite to the restrained side is subjected to 0.5 inch deflection by means of a motorized cam assembly equipped with a load cell, and the force (grams) is recorded. The test simulates in many respects the performance of a container as it is held in the hand of a consumer, supporting the weight of the container's contents. All measurements are done at standard TAPPI conditions for paperboard testing, 72° F. and 50% relative humidity.

As used herein, the term "rim stiffness" refers to the amount of deflection when a force (in grams unless otherwise specified) is applied to the bottom of the bowl. Rim stiffness can be determined by supporting a bowl with two 0.75" wide flats 180 degrees apart under the outer perimeter of the rim. A loading of 454 grams is applied to the bottom of the bowl. Deflection of a point at the intersection of the sidewall and R2 is measured when the weight is added. The less this reference point translates in a vertical direction, the more stiffness the rim provides.

The rim stiffness of the bowl 100 can range from a low of about 0.03 to a high of about 0.20. For example, the rim stiffness can be range from a low of about 0.03, 0.04, or 0.05 to a high of 0.07, 0.09, or 0.15. The rim stiffness can also be 0.06 to 0.08 inches (60 mils to 80 mils).

In some examples, the FPI rigidity of the bowl 100 can be a low of about 175 grams, about 200 grams, or about 250 grams to a high of about 300 grams, about 375 grams, about 425 grams, or about 475 grams, as measured by the Foodservice Packaging Institute rigidity system standard expressed in grams of force per 0.5 inches of deflection. In other examples, the FPI rigidity of the bowl 100 can be a low of about 200 grams, about 250 grams, or about 300 grams to a high of about 350 grams, about 375 grams, or about 450 grams, as measured by the Foodservice Packaging Institute rigidity system standard expressed in grams of force per 0.5 inches of deflection.

A basis weight of the bowl 100 and/or the paperboard blank can be a low of about 100 lbs/3,000 $ft^2$, about 150 lbs/3,000 $ft^2$, or about 200 lbs/3,000 $ft^2$ to a high of about 250 lbs/3,000 $ft^2$, about 275 lbs/3,000 $ft^2$, or about 400 lbs/3,000 $ft^2$. For example, the basis weight of the bowl 100 and/or the paperboard blank can be about 120 lbs/3,000 $ft^2$ to about 300 lbs/3,000 $ft^2$, about 185 lbs/3,000 $ft^2$ to about 275 lbs/3,000 $ft^2$, about 200 lbs/3,000 $ft^2$ to about 250 lbs/3,000 $ft^2$, or about 210 lbs/3,000 $ft^2$ to about 240 lbs/3,000 $ft^2$. The basis weight of the bowl 100 and/or the paperboard blank can also be about 120 lbs/3,000 $ft^2$ to about 240 lbs/3,000 $ft^2$.

A caliper of the bowl 100 and/or the paperboard blank can be a low of about 10 mils, about 13 mils, about 15 mils, or about 18 mils to a high of about 22 mils, about 24 mils, about 27 mils, or about 30 mils. For example, the caliper of the bowl 100 and/or the paperboard blank can be about 10 mils to about 30 mils, about 13 mils to about 27 mils, about 15 mils to about 24 mils, about 16 mils to about 23 mils, or about 18 mils to about 20 mils.

In one or more embodiments, the bowl 100 and/or the paperboard blank can have a basis weight of about 150 lbs/3,000 $ft^2$ to about 300 lbs/3,000 $ft^2$ and a caliper of about 13 mils to about 27 mils. In other examples, the bowl 100 and/or the paperboard blank can have a basis weight of about 175 lbs/3,000 $ft^2$ to about 300 lbs/3,000 $ft^2$ and a caliper of about 15 mils to about 23 mils. In other examples, the bowl 100 and/or the paperboard blank can have a basis weight of about 200 lbs/3,000 $ft^2$ to about 250 lbs/3,000 $ft^2$ and a caliper of about 18 mils to about 23 mils. In other examples, the bowl 100 and/or the paperboard blank can have a basis weight of about 210 lbs/3,000 $ft^2$ to about 230 lbs/3,000 $ft^2$ and a caliper of about 19 mils to about 21 mils.

The bowl 100 can have a capacity volume (CV). The capacity volume (CV) is the volume defined and contained by the boundaries of the bottom panel 110, the inner sidewall 120, and a plane extending across the highest point of the upper rim 140. The capacity volume (CV) can range from a low of about 400 $cm^3$, about 500 $cm^3$, or about 600 $cm^3$ to a high of about 800 $cm^3$, about 1,000 $cm^3$, and about 1,500 $cm^3$. In other examples, the capacity volume (CV) of the bowl 100 can be about 450 $cm^3$ to about 2,000 $cm^3$, about 750 $cm^3$ to about 1,500 $cm^3$, or about 1,000 $cm^3$ to about 1,200 $cm^3$ It has been surprisingly and unexpectedly discovered that a disposable bowl can maintain a high degree of rigidity despite having a relatively large surface area and wide flange. A wide flange (i.e. equal to or greater than 0.54 inches or 540 mils) provides a bowl that is easier to handle and carry by a consumer. Prior hereto, persons of ordinary skill in the art considered narrower flanges to be stiffer, less susceptible to deflection, and therefore, more desirable. However, it has been surprisingly and unexpectedly discovered that a disposable, pressware paper bowl can have a wide flange (i.e. equal to or greater than 0.54 inches or 540 mils) and maintain a FPI rigidity of about 100 grams or greater, such as, for example, about 250 grams, about 375 grams, about 425 grams, or about 475 grams, as measured by the Foodservice Packaging Institute rigidity system standard expressed in grams of force per 0.5 inches of deflection, and can further possess, for example, any one or more for the following characteristics: a ratio of the bowl height to diameter (H/D) of 0.18 to 0.20, a ratio of the flange width to bowl H (W:H) of 0.30 to 0.40; a ratio of the flange width to outermost diameter D (W:D) of 0.060 to 0.070; a ratio of the flange width to Rc (W:Rc) of 0.50 to 0.92; a ratio of R2 to Rc (R2:Rc) of from 0.050 to 0.150 and/or R3 to Rc (R3:Rc) of from 0.050 to 0.150.

It has also been surprisingly and unexpectedly discovered that a wide upper rim 140 with crowned upper surface (Rc) versus the same shape without the crowned upper surface results in 4 to 7% reduction in deflection, meaning stiffer, as less deflection means more stiffness. It has also been surprisingly and unexpectedly discovered that the wide upper rim 140 shape having three radii (R2, Rc, R3) can provide a 17-24% reduction in deflection versus the same wide upper rim having only two radii R2, R3 and minimal or no linear section between R2, R3. In other words, the wide rim design provided herein surprisingly and unexpectedly provided a bowl having an upper rim with significantly reduced rim deflection when lifting by the upper rim.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments, other and further embodiments of the invention can be devised without departing from the basic scope thereof, and the scope thereof is determined by the claims that follow.

What is claimed is:

1. A disposable bowl press-formed from a generally planar paperboard blank, comprising:

(a) a bottom panel;

(b) a first annular transition from the bottom panel defining a first radius of curvature, R1;

(c) a sidewall extending upwardly and outwardly from the first annular transition;

(d) a second annular transition from the sidewall defining a second radius of curvature, R2; and (e) a flange extending outwardly from the second annular transition portion, the flange comprising:

(1) a rim portion having an arched central crown with a convex upper surface defining a radius of curvature, RC;

(2) a third annular transition from the rim portion defining a third radius of curvature, R3, (3) an evert extending downwardly from the third annular transition, wherein the bowl has an outermost diameter, D, of about 8" to about 10" and a height to diameter ratio, H/D, of from 0.18 to 0.20; and (4) a flange width, W, that is a distance between intersecting points of a horizontal line extending through the sidewall and the outermost diameter D, wherein a ratio of the flange width to RC (W:RC) is 0.50 to 1.00.

2. The disposable bowl of claim 1, wherein a ratio of R2 to RC (R2:RC) is 0.050 to 0.150 .

3. The disposable bowl of claim 1, wherein a ratio of R3 to RC (R3:RC) is 0.050 to 0.150.

4. The disposable bowl of claim 1, wherein R2 is equal to R3.

5. The disposable bowl of claim 1, wherein R2 is not equal to R3.

6. The disposable bowl of claim 1, wherein the ratio of the flange width to RC (W:RC) is 0.52 to 0.92.

7. The disposable bowl of claim 1, wherein a ratio of the flange width to H (W:H) is 0.30 to 0.40.

8. The disposable bowl of claim 1, wherein a ratio of the flange width to H (W:H) is 0.32 to 0.37.

9. The disposable bowl of claim 1, wherein a ratio of the flange width to D (W:D) is 0.055 to 0.075.

10. The disposable bowl of claim 1, wherein a ratio of the flange width to D (W:D) is 0.060 to 0.070.

11. The disposable bowl of claim 1, wherein a volume of the bowl is greater than 30 fluid ounces.

12. The disposable bowl of claim 1, wherein the bottom panel has an arched central crown with a convex upper surface.

13. The disposable bowl of claim 12, wherein a portion of the arched central crown of the bottom panel defines a substantially continuous, convex arched profile spanning at least 75% of the horizontal distance between the center of the bottom panel and the first annular transition.

14. The disposable bowl of claim 1, wherein the sidewall is generally straight.

15. The disposable bowl of claim 14, wherein a first end of the generally straight sidewall is adjacent the first annular transition and a second end of the generally straight sidewall is adjacent the second annular transition.

16. The disposable bowl of claim 1, wherein the bottom panel has a generally planar upper surface.

17. A disposable bowl press-formed from a generally planar paperboard blank, comprising:

(a) a bottom panel;

(b) a first annular transition from the bottom panel defining a first radius of curvature, R1;

(c) a sidewall extending upwardly and outwardly from the first annular transition;

(d) a second annular transition from the sidewall defining a second radius of curvature, R2; and (e) a flange extending outwardly from the second annular transition portion, the flange comprising:

(1) a rim portion having an arched central crown with a convex upper surface defining a radius of curvature, RC, of 0.650" to 1.180";

(2) a third annular transition from the rim portion defining a third radius of curvature, R3, (3) an evert extending downwardly from the third annular transition, and (4) a flange width, W, that is a distance between intersecting points of a horizontal line extending through the sidewall and an outermost diameter, D, of the bowl, wherein a ratio of the flange width to RC (W:RC) is 0.50 to 1.00, the outermost diameter, D, is about 8" to about 10", and a height to diameter ratio (H:D) is from 0.18 to 0.20.

18. The disposable bowl of claim 17, wherein a ratio of the flange width to H is 0.30 to 0.40 and a ratio of the flange width to outermost diameter D is 0.055 to 0.075.

19. The disposable bowl of claim 17, wherein a volume of the bowl is greater than 30 fluid ounces.

20. A disposable bowl press-formed from a generally planar paperboard blank, comprising:

(a) a bottom panel;

(b) a first annular transition from the bottom panel defining a first radius of curvature, R1;

(c) a sidewall extending upwardly and outwardly from the first annular transition;

(d) a second annular transition from the sidewall defining a second radius of curvature, R2; and (e) a flange extending outwardly from the second annular transition portion, the flange comprising:

(1) a rim portion having an arched central crown with a convex upper surface defining a radius of curvature, RC, of 0.650" to 1.180";

(2) a third annular transition from the rim portion defining a third radius of curvature, R3, (3) an evert extending downwardly from the third annular transition, and (4) a flange width, W, that is a distance between intersecting points of a horizontal line extending through the sidewall and an outermost diameter, D, of the bowl, wherein:

a ratio of R2 to RC (R2:RC) is 0.050 to 0.150, a ratio of the flange width to RC (W:RC) is 0.50 to 0.92, a ratio of the flange width to bowl height (W:H) is 0.30 to 0.40, a ratio of the flange width to outermost diameter D (W:D) is 0.060 to 0.070, the bowl has an outermost diameter D of about 8" to about 10", the bowl has a height to diameter ratio, H/D, of from 0.18 to 0.20, and the bowl has a volume that is greater than 30 fluid ounces.

* * * * *